US007398560B1

(12) United States Patent
Swensen

(10) Patent No.: US 7,398,560 B1
(45) Date of Patent: Jul. 15, 2008

(54) HAT/VISOR WITH BRIM VENT

(76) Inventor: Julie A. Swensen, 917 Flagler Dr., #410, West Palm Beach, FL (US) 33401

( * ) Notice: Subject to any disclaimer, the term of this patent is extended or adjusted under 35 U.S.C. 154(b) by 0 days.

(21) Appl. No.: 11/704,281

(22) Filed: Feb. 9, 2007

Related U.S. Application Data

(63) Continuation-in-part of application No. 11/385,931, filed on Mar. 22, 2006, now abandoned.

(60) Provisional application No. 60/664,033, filed on Mar. 22, 2005.

(51) Int. Cl.
*A42C 5/04* (2006.01)

(52) U.S. Cl. ..... 2/182.3; 2/195.6; 2/182.8; 2/182.7; 2/182.2

(58) Field of Classification Search ..... 2/182.8, 2/182.7, 182.2, 182.3, 195.6, 195.1
See application file for complete search history.

(56) References Cited

U.S. PATENT DOCUMENTS

| | | | | |
|---|---|---|---|---|
| 1,175,167 | A | 3/1916 | Moscherrosch | |
| 1,486,102 | A | 3/1924 | Merton | |
| 1,955,986 | A | 4/1934 | Tice, Jr. | |
| 2,294,952 | A | 9/1942 | Blodjer | |
| 2,874,387 | A | 2/1959 | Bannister et al. | |
| 4,292,689 | A | 10/1981 | Townsend, Jr. | |
| D271,250 | S | 11/1983 | Burgin et al. | |
| 4,476,589 | A | 10/1984 | Burgin et al. | |
| D297,584 | S | 9/1988 | Lenox et al. | |
| 5,487,191 | A | 1/1996 | Ridley | |
| 5,647,060 | A | 7/1997 | Lee | |
| D386,888 | S | 12/1997 | Grant | |
| 6,199,214 | B1 | 3/2001 | Campbell | |
| 6,341,380 | B1 | 1/2002 | Coleman | |
| 6,526,595 | B2 | 3/2003 | Held | |
| 6,910,226 | B2 | 6/2005 | Hoyez | |
| 7,082,618 | B1 * | 8/2006 | Muso | 2/175.1 |
| 2004/0006807 | A1 | 1/2004 | Wang | |
| 2004/0231033 | A1 * | 11/2004 | Cho | 2/195.1 |
| 2007/0044203 | A1 * | 3/2007 | Hall | 2/171 |

FOREIGN PATENT DOCUMENTS

| | | |
|---|---|---|
| WO | WO87/01014 | 2/1987 |

* cited by examiner

*Primary Examiner*—Gary L. Welch
*Assistant Examiner*—Alissa J Tompkins
(74) *Attorney, Agent, or Firm*—Donald Grant Kelly

(57) ABSTRACT

Headwear such as a hat, cap, or visor with a headband and a brim extending outwardly therefrom includes a crescent shaped opening defined by an inner portion of the brim and an external leading edge of the headband. Beyond the opening the opaque brim extends away from the headband to an outward tip, and to lateral side edges. The opaque brim is attached at its lateral edges directly to the external leading edge of the headband. The crescent shaped opening allows more flow at a central area of the brim, yet it narrows toward lateral edges of the brim to ensure that sunlight toward the wearer's sides is adequately blocked from eye contact. This novel structure provides maximum shading of the wearer's face, yet directs considerable airflow from beneath and above the brim through the opening to cool the wearer's eccrine glands along the forehead.

7 Claims, 2 Drawing Sheets

HAT/VISOR WITH BRIM VENT

CROSS REFERENCE TO RELATED APPLICATIONS

This application is a Continuation-in-Part of Non-provisional patent application Ser. No. 11/385,931 filed Mar. 22, 2006 (now abandoned); in turn, entitled to the benefit of Provisional Patent Application Ser. No. 60/664,033 filed Mar. 22, 2005, both of which are incorporated in their entirety herein. All benefits of priority of both such patent applications are hereby claimed under 35 USC 120 and 35 USC 119(e), respectively.

STATEMENT REGARDING FEDERALLY SPONSORED RESEARCH OR DEVELOPMENT

Not applicable.

REFERENCE TO SEQUENCE LISTING

Not applicable.

REFERENCE TO MICROFICHE APPENDIX

Not applicable.

BACKGROUND OF THE INVENTION

This invention relates to headwear such as hats, caps, visors and the like for use by people of all age groups, and in particular those having brims or bills extending outwardly therefrom.

The present invention relates particularly to hats, visors and the like with a unique brim or bill venting feature that serves to protect the wearer from overheating. This is useful in safeguarding physical well-being as well as enhancing the wearer's comfort and improving performance in sports and recreation. The headwear may be of the type that includes a brim incorporated into a crownless headwear which comprises a partial headband (as opposed to the type of headband that entirely surrounds the wearer's head. The present invention also relates to a crownless visor of the type with a headband fully surrounding the wearer's head, where the brim or bill is attached to, or integrated into the headband. The present invention further relates to the typical sport hat or cap structure that includes a crown fitted to a headband For many generations, visors and hats of all types, fabricated of a variety of materials, have played not only fashion roles, but protective roles, as well. Hats made of natural and synthetic material have protected users both from the debilitating heat of the sun and from chilling effects of wintry weather. Equipped with brims or visors, such headwear serves to keep the elements such as snow and rain away from the face and other body areas such as ears and neck. Large-brimmed hats can serve to shade or protect much of the user's body.

On sunny days, headwear brims most frequently serve to block the sun's harmful rays and other bright light sources from users' skin and eyes. However, those who wear headgear, particularly as an aspect of their jobs or frequent sports participation, often have acknowledged that hats and caps tend to collect heat especially under the crown and within the confines of the visor brim. For this reason, hat crowns have been modified by incorporating air passages in and out of the crown enclosure.

In some instances the headwear material itself is designed or fabricated so as to include a venting feature. In other cases, a manufactured hat is furnished with passageways such as small grommets or other vent structures permitting air passage directly through a crown or peak portion. Similar attempts to ventilate a hat-covered head have featured small air pathways added just inside a hatband and directly adjacent the wearer's head within the crown.

Among a variety of popular structural fabric for hats and visors are woven natural and synthetic fibers or strands. These may be coarsely woven or molded in such a way as to afford air pathways between the fibers and strands. Air pathways also are afforded to hats that are partially if not fully fabricated of a mesh or net material. Headwear of this type is sometimes referred to as a summer hat. Summer hats are typically lightweight and comfortable for warm season wear, particularly since the pathways permit trapped hot air to escape from a crown or peak. Another purpose for providing holes or air passages through a cap crown and/or visor is to present a distinctive decoration. Still another objective in providing air vents is to provide hat ventilation in an attempt to keep headwear from blowing off the wearer's head.

As an example of a woven, ventilated hat, U.S. Pat. No. 1,955,986 issued to Tice, Jr. illustrates a structure wherein the weave is more open around a portion of the crown than elsewhere on the hat, so as to form an air vent effect. U.S. Pat. Nos. D271,250 and 4,476,589 issued to Burgin et al. illustrate another ventilated hat design wherein a vent is positioned on a crown portion above the brim.

Lenox et al., in U.S. Pat. No. D297, 584, illustrate a cap with a fan built into a visor portion (on a forward portion thereof), and further illustrates what appears to be a mesh fabric for a rear portion of the crown. Merton, in U.S. Pat. No. 1,486,102 illustrates a cap having a ventilation opening to the cap crown which is sewn to the visor at a location described as materially outward from the inner edge of the visor. Thus, the cap is said to be ventilated to the interior of the crown through a foraminous mesh covering the opening. Moscherrosch's U.S. Pat. No. 1,175,167 shows a shaded, transparent visor structure fabricated to protect the wearer's eyes from dust, wherein the brim, headband and crown are shown in alignment (appearing at a substantially 180 degree angle or straight line, rather than at a measurably less obtuse angle typical of active sport hats, visors and caps). With Moscherrosch's invention, the wearer peers directly through the transparent visor and the eyes are protected from dust. Relatively small air holes are provided for ventilation.

U.S. Pat. Nos. D386,888 and 6,910,226 to Grant and Hoyez respectively show caps with openings directly above a brim as opposed to "on the brim." Specifically, the hat crowns are furnished with forward-facing openings situated above a brim portion.

In the published US patent application designated as US 2004/0006807, Wang shows a layered cap structure that includes on the crown and visor a netted "see through" cloth material under which is added various patterned linings. These linings have cuts and cut holes for showing patterns and ventilation. The holes are positioned along a front portion of the cap crown (or peak) as well as along the visor well outward beyond the general area disposed just above the wearer's forehead.

Campbell, in U.S. Pat. No. 6,199,214 teaches the placement of a ventilation device within a cap or hat so as to be positioned between the sweat band and the user's forehead. This structure is formed with gaps that allow for air flow between the user's head and the headband. Similarly, Held's U.S. Pat. No. 6,526,595 provides an air circulation device that is adapted to fit within the head band of a cap, and positioned between the wearer's head and the cap. Emmet discloses, in published document WO87/01014, headwear with a brim furnished with ventilation passages between the wearer's head and the internal area of a hat crown.

Loss of a hat in the wind is an issue addressed by Ridley's visor mounted vent structure illustrated and described in U.S. Pat. No. 5,487,191. Specifically, Ridley shows an opening in a cap brim for a vent assembly. The purpose stated in Ridley's patent abstract is for permitting a flow of air through the visor, thereby precluding unintentional removal of the cap by wind currents. Ridley's visor cap vent may take the form of an integrally molded vent element having a predetermined shape and fixedly secured to the visor. It is noted that the vent opening for Ridley's various embodiments is spaced away from the wearer's forehead and cap crown.

Another invention intended to prevent a cap from being blown off the wearer's head by a wind gust is presented in U.S. Pat. No. 2,874,387 by Bannister et al. Bannister et al. illustrate a cap with a visor having a rim extended therearound. Affixed to, or integral with, the rim are slats or vanes tilted backward toward the cap crown area. These angled slats may be fixed in their tilted position or individually adjusted on pivots in the cap rim.

The vanes presented by Bannister et al. form reaction surfaces against which wind pressure and air resistance serve (as air flow upwardly through the slots or vents in the visor) to release pressure and resistance in such as way as to generate a downward reaction on the vanes to aid in preventing the cap from blowing from the head of the wearer. There appears to be no disclosure of vertically open passageways since such an arrangement would not result in the downward reaction feature sought by Bannister et al. This disclosure appears to operate only with the vanes fully closed or tilted to form the reaction surface.

The visored hat construction depicted by Townsend, Jr. in U.S. Pat. No. 4,292,689 is an outwardly projecting substantially planar visor portion of a predetermined thickness formed generally as an open cell configuration. The cells of Townsend, Jr. are formed, for example, in the shape of slanted, arcuate or honeycomb passageways which are angled so as to keep sunlight from the wearer's eyes yet permit the sun's rays to hit the wearer's face below the eyes. The construction affords a lighter hat and one that will not easily blow off of the wearer's head.

Lee's invention presented in U.S. Pat. No. 5,647,060 illustrates a headgear with head-engaging band designed to support a transparent, protective face mask used, for example, by medical personnel to avoid cross contamination with patients. The band includes a bill with cutouts or apertures to permit air circulation as well as to promote passage of light to the area between the interior of the shield and user's face. Coleman's U.S. Pat. No. 6,341,380 presents a dome-like rain hat with air apertures provided around the mid-portion of an annular brim. Blodjer's U.S. Pat. No. 2,294,952 presents an eyeshade protector against wind, flying objects and the like. The wearer mounts the eyeshade visor directly against the face, engaged at the forehead, and looks directly through the eyeshade. At an area above the eyes, openings are provided to allow air to flow from behind the eyeshade and out the openings.

Thus, the prior art reveals a wide range of hats, caps and face/eye shields, some configured with brims, visors, bills and the like, as an assertion of fashion or more practically to protect the wearer from the rain, sun, flying objects and other elements. These prior art hats or headgear may or may not include crowns, but generally include at least a head band of some sort. Also present in the prior art are numerous modifications to headwear crowns and/or visors such as the provision of passages or openings for appearance, for affording an air flow, or both. The airflow, as noted hereabove may be for any of a number of reasons including ventilation or for preventing the wind from blowing the headwear from the wearer's head.

What is needed and clearly absent in the prior art, is a hat or crownless visor with a brim, bill, or the like (henceforth referred to as a "brim") which substantially blocks light passage through use of an opaque fabric or material, yet is specially formed or fabricated to define a passage therethrough to openair or ambient atmosphere above and below said brim an directly adjacent wearer's face. This is to foster or promote bidirectional air flow through the brim such that it will flow generally vertically across an area closely adjacent the wearer's eyes and forehead, venting to open air. Further needed is a brim vent configuration that takes advantage of the natural configuration of a wearer's face to afford openair passage adjacent the forehead and eyes while not permitting light from the sun, stadium lights and the like to interfere with the wearers vision. This is critically important in permitting a sport-active person's naturally cooling mechanism to function properly, most especially when that person is highly active and/or the ambient temperature is relatively high. The following will explain.

Sweat evaporating from a person's skin acts to cool the skin and remove excess heat. Conversion of liquid sweat to vapor takes a certain amount of heat called heat of vaporization. This principle permits air flow to act as a heat transfer medium to remove excess heat from the skin (and, thus, from the body). A human's most common sweat glands are the eccrine glands found mostly on the palms, soles of the feet and the forehead. Since the hands and feet of one engaged in activities are often occupied or covered, it stands to reason that the forehead bears a major proportion of the natural heat transfer.

A person's forehead includes more than 175 eccrine glands per square centimeter, according to Henry Gray's *Anatomy of the Human Body,* $39^{th}$ ed., C. V. Mosby 2004). To ensure these glands operate as an efficient heat transfer system, it is critically important that they are not trapped or enclosed beneath a hat or visor without adequate ventilation. The present invention effectively resolves the shortcomings and inadequacies of the prior art in satisfying this long felt need.

The headwear of the present invention includes as its principal parts, a headband for engaging the wearer's head and interconnected to a light impervious or opaque brim. As a feature of either a cap with crown or a crownless visor, the brim itself is of a predetermined thickness and has an under surface and upper surface as also is typical. Also typically, the brim is directly joined to an exterior leading edge of said headband and has a predetermined unfettered extension outwardly therefrom to a distal brim tip. In other words, as should be apparent from the accompanying illustrations, the brim unit of the present invention is directly interconnected or bonded only at the headwear headband and is otherwise unfettered or without bonds or connections throughout its extension freely outward from its direct interconnection along said headband to the brim unit tip. The brim has a predetermined lateral extent, that is, an extent from a first lateral side to a second lateral side thereof. The brim enjoys a length and breadth commonly found in the prior art as affording adequate shading and shelter of the wearer's eyes and face. However, the brim presented herein enjoys a unique characteristic not found in the prior art, as will now be described.

At its area of joinder to a headband and positioned outwardly of the headwear crown (when a crown is included) or head interconnection (in the case of crownless visors), the brim is configured to define a singular opening, which opening has no direct interconnection with a headwear crown or head interconnection. This opening is generally crescent-shaped and extends along the headband exterior leading edge for a majority of the lateral extent of the brim. The opening extends between the under surface of the brim throughout its thickness to an upper surface of the brim. The opening is formed to vent directly to the atmosphere and is unencumbered at both upper and lower surfaces.

Typical of crescent shapes the opening is formed as a larger open area flanked by narrowing ends. Positioned on a hat or visor brim extending along the headband external leading edge, the larger open area of the unitary opening lies generally at a brim center area, and is directly aligned with a substantially central portion of the headband exterior leading edge. In other words, the brim opening is generally centrally located laterally along the headwear.

Each narrowing end of the crescent-shaped opening terminates at a point along the exterior edge of the headband, generally adjacent respective lateral edges of the brim. The narrowing ends afford minimal, if any, sunlight passage. Since the central opening is positioned just above the wearer's brow to vent the wearer's eyes and forehead to the atmosphere, sunlight from directly overhead also is not a problem.

Lateral portions of the brim join the headband external leading edge at the respective points where narrowing ends of the crescent-shaped opening terminate. It has been found that a minimal interconnection area is adequate for structural integrity of the brim and headband. The opening may remain uncovered for maximum flow of air therethrough.

Alternatively, a net or mesh fabric which is foraminous in nature may be provided to cover the crescent-shaped opening from its outer to an inner edge thereof. Typically, the brim itself is constructed of, or covered by, a cloth fabric generally similar to that often found on the headband and/or crown. The cloth fabric on the brim advantageously affords a base to which net material may be sewn, or other foraminous material may be fastened.

The foraminous material serves as a sunlight filter and modest weather barrier while still affording substantial air flow. Depending on its stiffness, the net also may serve to stabilize or reinforce the brim/headband interconnection since the net, throughout its lateral extent may as illustrated, be directly joined to the headband. An additional advantage is that the crescent-shaped opening, particularly as covered by net material, stylishly blends with brim designs.

In such an arrangement, air confined or forced beneath the headwear brim lower surface will be permitted or even impelled (as for example by the wearer's movement) against and along the wearer's face. Following a path of least resistance, the air then angles upwardly across the wearer's forehead and is vented to the atmosphere through the unitary opening or passage through the brim.

Similarly, and under certain conditions, outside or atmospheric air will flow downward along the wearer's face from above the brim. The generally crescent opening defines a passageway that is generally perpendicular to upper and lower brim surfaces, and immediately adjacent the wearers forehead. Even the slightest movement of flowing air in either direction upward or downward, will significantly cool the wearers skin since this particular skin area includes a significant number of eccrine glands, as discussed above.

The nature of this unique headwear structure is believed to actually accelerate the air as it moves to the general area of the wearer's face. Even a modest headwind or forward movement of the wearer acts to push air along the under surface of the outwardly extended brim, and backwards toward the wearer's eyes and forehead. Since this unique brim design does not trap air against the wearer's face, air escapes instead to the atmosphere upwardly through the brim's crescent shaped opening. Similarly, as noted above, air from the surrounding atmosphere may flow downwardly through the passage and into the area of the wearer's forehead, exiting to the atmosphere therebelow.

In either direction, air motion will be accelerated through the crescent shaped passage due to a natural Venturi Effect of the constricted opening. The result is that the air motion speeds up as it crosses upwardly or downwardly against areas surrounding the user's eyes and forehead. Air flow acceleration enhances heat exchange on the user's skin precisely where sweat glands are functioning.

Among the advantages of the present invention are included: a lowering of body heat through lowered skin temperature; notably increased comfort and safety for the wearer. The slightest increase in airflow across a wearer's forehead will promote sweat evaporation and provide considerable dissipation of facial heat which is a principal cause of fogged eyeglasses, eye irritation and flushing during recreation and sports activities.

A variety of materials can be used in constructing or fabricating the unique hat and visor components. These may include fabric of the cloth type discussed above and typically found in baseball caps/hats and the like. Other suitable materials may include natural fibers, strips or bands of webbing, as well as molded plastic or other synthetics, any of which may be utilized without departing from the scope of the present invention described and claimed herein. Illustrated herein are typical headwear constructions (such as traditional baseball cap with opaque reinforced fabric brims, as well as fabric covered plastic visors of well known construction.

BRIEF DESCRIPTION OF THE DRAWINGS

The invention will be best understood by reference to the following detailed description of an illustrative embodiment when read in conjunction with the accompanying drawings, wherein.

DETAILED DESCRIPTION OF THE INVENTION

Figure 1:
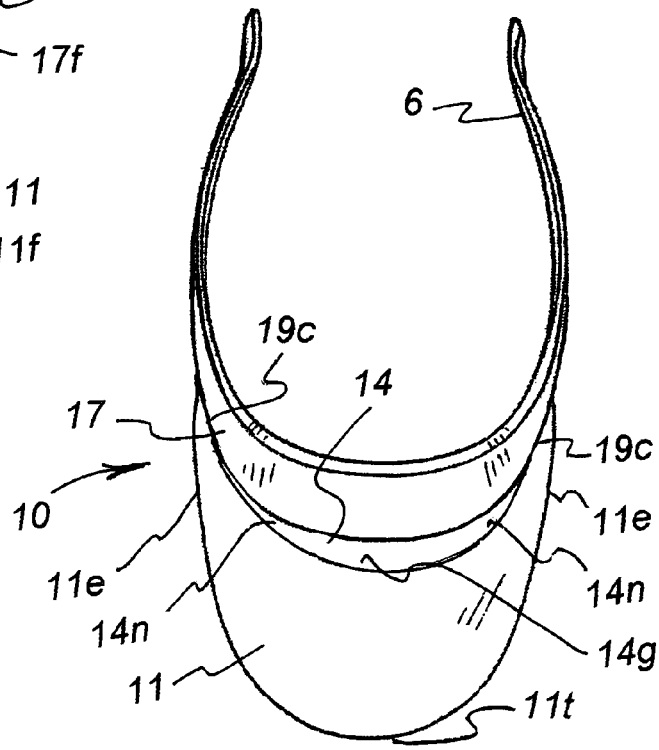
FIG. 1 is a plan view of headwear with a brim defining a crescent-shaped open vent in accordance with the present invention.
Figure 3:
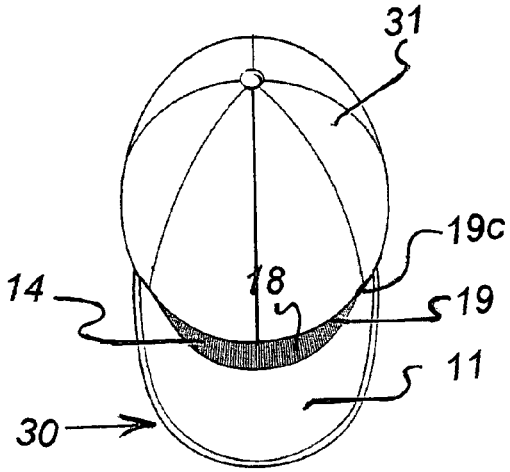
FIG. 3 is a plan view of a sports cap with a brim defining an open vent with a mesh cover over said vent.
Figure 4:
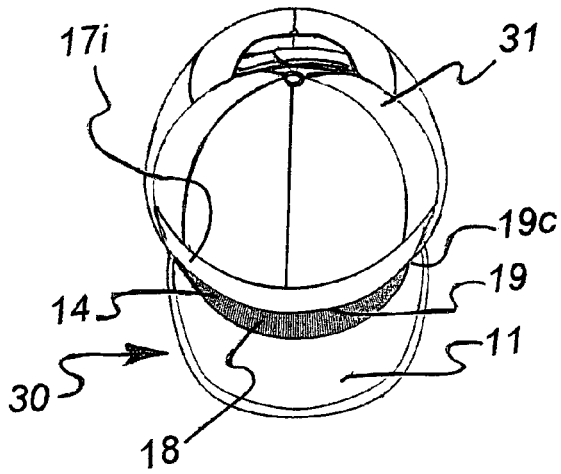
FIG. 4 is an inverted view illustrating the inside of the sports hat of FIG. 3.
Figure 5:
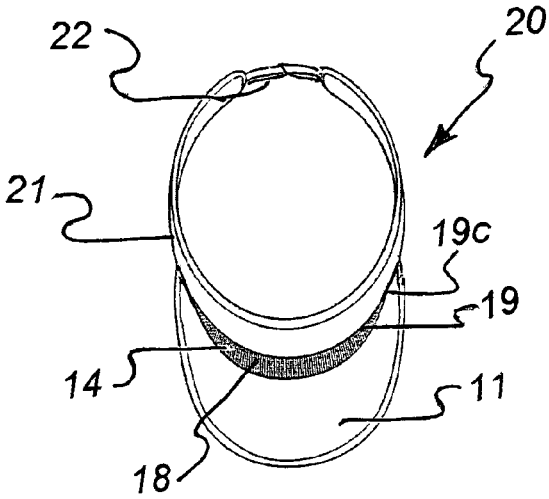
FIG. 5 is a plan view of a headwear in the form of a crownless visor and headband defining an open vent section with a net insert covering said vent.
Figure 6:
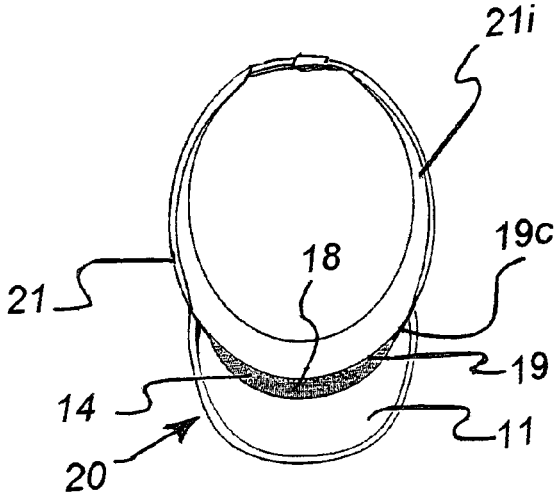
FIG. 6 is an inverted view illustrating the inside of the crownless visor and headband of FIG. 5.

As viewed in FIG. 1, visor 10 includes brim unit 11 and a head-connecting headband element 6 on either side thereof. These elements 6 are interconnected by a front headband portion 17. It is noted that the term headband in the present context may include a crownless visor headband portion as shown at 17 or may refer to a head-encompassing headband more typical of caps with crowns, to be further discussed herebelow. As is well known in the crownless visor field, elements 6 are typically fabricated or molded of a structure with material memory. This is so that they may be deformed to part slightly from an initial relaxed configuration to be placed on the wearer's head. On pressure release, elements 6 recover their original shape so as to press against the head in a known manner, thus snuggly mounting to a wearer's head at a position generally above the wearer's ears.

Headband 17 presents an external leading surface edge 19. Interconnected at said edge 19 and extending at an angle outwardly therefrom in a generally forward direction from headband 17 is brim unit 11. The majority of brim unit 11 is fabricated so as to be continuous and uninterrupted (as by holes, openings, slots or passages therethrough). Brim 11 unit is formed or constructed in a well known manner so as a generally opaque sunshade and configured so as to join leading edge 19 headband 17 at an angle.

Brim unit 11 is generally opaque to substantially block sunlight, stadium lights, and the like. Brim unit 11 is viewed, for example, in FIG. 1 as extending outwardly and forwardly of headband 17 so as to shade the face and eyes. FIG. 1 further depicts brim unit 11 directly interconnected only alone said headband leading edge and having a predetermined unfettered extension freely outward from its direct interconnection along said headband to a brim unit tip. The brim unit further has a predetermined extent from a first lateral side of said brim unit to a second lateral side of said brim unit. Typical of active sports headwear such a brim unit 11 is constructed so that it intersects at an angle with respect to headband 17. In other words, an angle is defined between brim unit 11 and front profile of headband 17 so as to extend outwardly from the headband 17 in a manner that does not interfere with a wearers forward vision. Said angle measured externally of the upper surface of the brim unit 11 typically ranges from substantially more than 90 degrees to substantially less than 180 degrees, as for example from around 110 to 140 degrees. An angle greater than this general range will hamper the vision of wearers constrained to look at an underside of the brim unit 11.

Outwardly of headband external leading edge 19, the brim unit 11 has a predetermined extent to brim unit tip 11*t* and a predetermined lateral extent to side edges 11*e*. At an area of joinder at, and along, headband external leading edge 19, brim unit 11 is physically configured to define and include generally crescent-shaped airflow opening 14 to serve as an open air passage. Opening 14 extends along the headband leading edge 19 a majority of brim unit 11 lateral extent. Typical of crescent-shaped openings, a greater opening area 14*g* diminishes to narrowing ends 14*n*. Directly joining headband external leading edge 19, the greater open area 14*g* is seen as lying generally at the brim unit 11 center, and is directly aligned with a substantially central portion of the headband exterior leading edge 19.

Narrowing ends 14*n* of the crescent-shaped opening 14 terminate respectively at points along exterior leading edge 19 of headband 17. Each terminal point is generally adjacent a respective lateral edges 11*e* of brim unit 11. The narrowing ends 14*n* allow airflow yet permit minimal, if any, sunlight passage. The crescent-shaped configuration complements a wearer's natural facial structure. Since central opening 14 is generally positioned above the wearer's brow, sunlight passing through opening 14 will not strike the wearer's eyes. Where the wearer's brow naturally recedes to the sides, the narrowing ends 14*n* serve to limit the entrance of light.

Thus, maximum airflow is afforded from beneath brim unit 11 into an openair area above brim unit 11, and without compromising the light-blocking advantages of an opaque brim. It will be evident that brim unit 11 is essentially interconnected to headband 17 external leading edge 19 only at areas indicated as 19*c*. This minimal interconnection, for typical fabric and plastic-molded visors, caps and hats has been found to be adequate.

Figure 2:
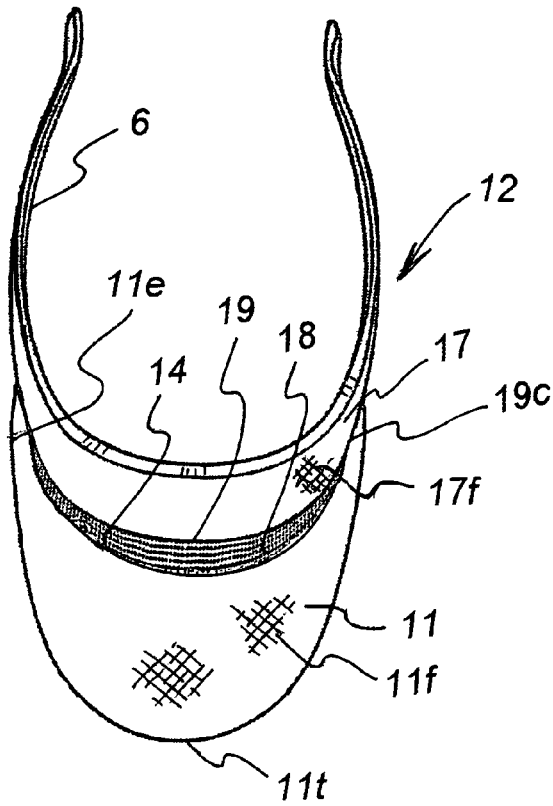
FIG. 2 is a plan view of a visor and brim embodiment similar to FIG. 1, but with a fabric overlay and defining an open vent covered by a new material.

Illustrated in FIG. 2 is a visor 12 with brim unit 11 essentially the same as those elements shown in FIG. 1, except that fabric material 11*f* and 17*f* are positioned or bound upon the surfaces of brim unit 11 and headband 17 respectively. In this configuration, the provision of a foraminous net 18 (as, for example, by sewing or stitching to fabric 11*f* and 17*f*) covering crescent-shaped opening 14 serves a number of additional advantages. This creates a stylishly popular look for headwear fashion and, without significant airflow interference. Further, the net 18 will serve to filter sunlight or stadium lights and form at least a modest barrier to precipitation. The foraminous net 18, if stiff enough also will stabilize or reinforce the interconnection between brim unit 11 and headband 17 at areas 19*c*. If necessary, additional stiffening or reinforcing material may be incorporated at or nearby where the foraminous material 18 is sewn.

Air which normally would collect beneath heated visor brim unit 11 is encouraged or impelled across the wearer's face and outwardly through opening 14 thus serving as an openair heat exchange medium. Additionally, under certain conditions, air may flow downwardly from above visor brim unit 11 and through opening 14. Again, this bidirectional movement of air through the crescent shaped opening to and from ambient atmosphere at upper and lower brim unit 11 surfaces and across the wearer's forehead and eyes serves to cool and dry said forehead and eyes.

FIGS. 3-6 illustrate how the present invention applies equally well to a typical sports hat 30 with crown 31, as well as crownless hat 20. In each illustrated example, a net material 18 may be provided as an insert or appliqué. In the sports hat embodiment illustrated in FIGS. 3 and 4, brim unit 11 is joined at headband leading external edge 19 of headband 17, the internal surface 17*i* of which is viewed in FIG. 4. In crownless hat 20 illustrated in FIGS. 5 and 6, headband 21 may be fastened to the wearer's head by any suitable connector 22, for example a hook and loop fastener such as VELCRO®. Again, brim unit 11 joins headband 21 at exterior edge 19 thereof. The interior of headband 21 is shown at 21*i*.

It should be noted that the exact headwear shape, fabric and styling details are not important to the utility of the unique invention described and claimed. For example, the sports hat pictured in FIG. 3 need not have the rigidly rounded crown typical of a standard baseball cap, but could embody a less structured crown typical of the ubiquitous unisex sports caps well known for a gradual rise from brim unit 11 to crown top or peak 31.

Contrarily, the shape and placement of the generally crescent opening 14 (or openair vent) along the lowermost portion (leading edge 19) of the headband is, in fact, important to achieving optimum effects of airflow, heat exchange, light exclusion and wearer satisfaction. In headwear with a crown or peak such as crown 31 illustrated in FIG. 3, the vent 14 must of course be separate and external of said crown so as to permit airflow as described. When placed on a wearer's head, the lowermost portion of the headband 17 usually engages the user's forehead. By positioning headband 17 such that the openair vent 14 is nearest the wearer's hairline, maximum ventilation along the forehead will occur.

Headwear crown or peak 31 may be natural or synthetic cloth fabric or other equivalent construction as desired. As with other embodiments described herein, brim unit 11 extends outwardly from hat 30 headband 21 adjacent the wearer's forehead. Brim unit 11 is configured at an angle to headband 21 to afford the wearer an unobstructed frontal view beneath said brim unit 11, while protecting the wearer's eyes from the sun. The crescent-shaped opening 14, whether fully open or covered by foraminous net 18, affords a refreshingly cooling air passage as described.

A variety of headwear brim ventilation opening shapes and positions have now been tested. It is clear that the invention as presently clearly described and claimed herein affords optimum results. The novel product is attractive and effective in its construction, and affords considerable air passage to the open air as a heat exchange medium while simultaneously blocking damaging and blinding rays of the sun while engaged in outdoors sports and recreation.

Although various embodiments of the present invention have been described in the foregoing detailed description an illustrated in the accompanying drawings, it will be understood that the invention is not limited to the embodiments disclosed, but may assume numerous arrangements, rearrangements, modifications, and substitutions of steps without departing from the spirit of the invention nor from the scope of the following claims.

I claim:

1. Headwear comprising a headband and an opaque brim unit extending generally outwardly therefrom, said headwear further including:

said headband having an interior for engagement with a wearer's head said headband further having an exterior leading edge;

said opaque brim unit is directly interconnected only to said headband exterior leading edge so as to extend laterally along said exterior leading edge;

said brim unit having a predetermined unfettered extension freely outward from its direct interconnection along said headband to a brim unit tip, and having a predetermined extent from a first lateral side of said brim unit to a second lateral side of said brim unit;

said brim unit is configured to at least partially define and include a generally crescent shaped opening at and along the headband leading edge and extending for a majority of the lateral extent of the brim unit;

said crescent shaped opening is defined as having a larger central open area flanked by narrowing ends thereof;

each of said narrowing ends terminates at a point along the headband exterior leading edge and generally adjacent a respective lateral side of said brim unit;

said opening is further defined as extending between a lower brim unit surface and an upper brim unit surface and open to surrounding ambient atmosphere at said upper and lower brim unit surfaces;

whereby said opaque brim unit shields a wearer's eyes and face while air passes bidirectionally through said crescent shaped opening to and from the ambient atmosphere and across forehead and eye areas of the wearer thus serving to cool and dry said forehead and eye areas.

2. The headwear of claim 1 further characterized by:

said crescent shaped opening includes a foraminous material cover;

whereby said cover serves to filter sunlight and structurally reinforces an interconnection of the brim with headband exterior leading edge.

3. The headwear of claim 2 further characterized by:

said crescent shaped opening is at least partially defined by said headband exterior leading edge;

the predetermined extension of said opaque brim outwardly beyond said crescent shaped opening is continuous and uninterrupted to said brim tip.

4. The headwear of claim 3 further characterized by:

said brim unit and said headband are covered by a fabric material;

said foraminous material is a net sewn to said fabric material so as to entirely cover said crescent shaped opening.

5. The headwear of claim 4 further characterized by:

said headwear comprises a sport cap with a crown;

said crown is directly attached to said headband and has a maximum circumference not greater than said headband circumference;

said opening is defined as separate and external of said crown and having no direct interconnection thereto.

6. The headwear of claim 4 further characterized by:

said headwear comprises a crownless visor.

7. The headwear of claim 1 further characterized by:

said crescent shaped opening is at least partially defined by said headband exterior leading edge; the predetermined extension of said opaque brim outwardly beyond said crescent shaped opening is continuous and uninterrupted to said brim tip.

* * * * *